US012799564B2

(12) United States Patent
Lu et al.

(10) Patent No.: US 12,799,564 B2
(45) Date of Patent: Nov. 17, 2026

(54) HIGH-TEMPERATURE HIGH-ENTROPY ALLOY WITH LIGHT WEIGHT AND HIGH STRENGTH IN AS-CAST STATE AND PREPARATION METHOD THEREOF

(71) Applicant: City University of Hong Kong Shenzhen Futian Research Institute, Shenzhen (CN)

(72) Inventors: Jian Lu, Guangdong (CN); Qing Wang, Guangdong (CN); Yi Zhang, Guangdong (CN); Yihui Li, Guangdong (CN); Shasha Qi, Guangdong (CN)

(73) Assignee: City University of Hong Kong Shenzhen Futian Research Institute, Shenzhen (CN)

( * ) Notice: Subject to any disclaimer, the term of this patent is extended or adjusted under 35 U.S.C. 154(b) by 314 days.

(21) Appl. No.: 18/806,401

(22) Filed: Aug. 15, 2024

(65) Prior Publication Data

US 2024/0410035 A1 Dec. 12, 2024

(30) Foreign Application Priority Data

Nov. 10, 2023 (CN) ..... 202311505150.3

(51) Int. Cl.
*C22C 14/00* (2006.01)
*C22C 1/02* (2006.01)

(52) U.S. Cl.
CPC ..... *C22C 14/00* (2013.01); *C22C 1/02* (2013.01)

(58) Field of Classification Search
CPC ..... C22C 14/00; C22C 1/02
See application file for complete search history.

(56) References Cited

FOREIGN PATENT DOCUMENTS

CN 114622119 A 6/2022
CN 114855050 A 8/2022

*Primary Examiner* — Ricardo D Morales
(74) *Attorney, Agent, or Firm* — Nutter McClennen & Fish LLP

(57) ABSTRACT

The disclosure relates to a high-temperature high-entropy alloy with light weight and high strength in as-cast state and the preparation method thereof. The high-temperature high-entropy alloy is composed of Ti, Al, Nb, V, and Sc elements, and has an alloy composition of $Ti_{(2.9\text{-}3.1)}Al_{(1.9\text{-}2.1)}Nb_{(0.8\text{-}1.2)}V_{(1.9\text{-}2.1)}Sc_x$, where $0.1 \leq x \leq 0.3$. Moreover, the disclosure provides a method for preparing the high-temperature high-entropy alloy by melting. The preparation method of the high-temperature high-entropy alloy with light weight and high strength proposed by the disclosure is simple with uniform organization and less casting defects, which is suitable for promotion and use.

11 Claims, 3 Drawing Sheets

HIGH-TEMPERATURE HIGH-ENTROPY ALLOY WITH LIGHT WEIGHT AND HIGH STRENGTH IN AS-CAST STATE AND PREPARATION METHOD THEREOF

CROSS-REFERENCE TO RELATED APPLICATIONS

This application claims priority to Chinese Patent Application No. 202311505150.3, filed on Nov. 10, 2023, which is hereby incorporated by reference in its entirety.

FIELD OF TECHNOLOGY

The disclosure relates to a high-temperature high-entropy alloy with light weight and high strength in as-cast state and the preparation method thereof, and belongs to the field of metallurgy technology.

BACKGROUND OF ART

With further development of the aerospace industry, engine components will face more severe service conditions, namely, higher operating temperature, and greater impact load, and need to have a longer service life. Currently used high-temperature titanium alloys have a "thermal barrier temperature", and once the temperature in use exceeds 600° C., titanium alloys will lose most of high-temperature strength and fracture toughness. Moreover, Titanium alloys also have a tradeoff relationship between strength and toughness similar to conventional alloys, and the composition design and thermomechanical processing of high-temperature titanium alloy are complex, which has led to a bottleneck in the development of high-temperature and high-strength titanium alloys.

The academic and engineering communities are currently searching for new high-temperature alloys that can meet the increasingly demanding high-temperature service environments. High-entropy alloys are regarded as highly promising materials due to their excellent structural and functional properties. In addition, each main element in the high-entropy alloys will have a great dominant role in the structural manipulation and overall performance of the alloys, which greatly expands the system scope of metallic materials alloy design and allows the alloy composition to have more room for regulation. Perhaps, the development and design of high-entropy alloy system with a density close to that of titanium alloy, higher service temperature, more excellent specific strength, ductility and toughness and better processability can effectively promote the development of aerospace industry.

New high-entropy alloys comprising refractory metal elements with melting points higher than 1,650° C., such as Ti, V, Cr, Zr, Nb, Mo, Hf, Ta and W, as the main elements have better high-temperature mechanical properties than the traditional high-temperature alloys, and have great potential for application at high temperatures.

Patent application No. 202210497849.9 for invention specifically discloses a refractory high-entropy alloy with light weight and high strength and the preparation method thereof. The compositional expression of the alloy is $MoNbVTa_{0.5}Al_x$, wherein $0<x<1$, and the ratio in the compositional expression is a relative atomic ratio. In this preparation method, pure metal elementary substances of Mo, Nb, V, Ta and Al are used as raw materials, and each metal raw material is weighed and proportioned according to the alloy composition; an Al—V pre-alloyed ingot is prepared using Al and V raw materials by vacuum arc melting, and a Mo—Nb—Ta pre-alloyed ingot is prepared using Mo, Nb and Ta raw materials by vacuum arc melting; the Al—V pre-alloyed ingot and the Mo—Nb—Ta pre-alloyed ingot are mixed for vacuum arc melting, to prepare a Mo—Nb—V—Ta—Al alloy ingot.

Most of the refractory high-entropy alloys are too high in density due to the addition of heavy elements of high melting point. Although a small amount of light element Al is added to the above alloy, its density is still above 8 g/cm$^3$, which is much higher than that of high-temperature titanium alloy. In addition, the refractory high-entropy alloys generally have extremely low compressive ductility at room temperature, and the processability is also poor.

The density of the high-entropy alloy is greatly reduced by increasing the proportion of light elements such as Ti and Al. Patent application No. 202210193405.6 for invention provides a light-weight high-strength high-entropy alloy with high aluminum content and the preparation method thereof. For this high-entropy alloy, low-density Al, Mg and Ti elements are selected as the basis, and Cr, V and non-metallic element Si, which have relatively low density and high strength properties, are added. The high-entropy alloy, which has a density close to that of aluminum alloy, while having excellent mechanical properties, such as high hardness and wear resistance, is prepared by horizontal low-speed ball mill mixing+high-energy ball milling+discharge plasma sintering process.

Although the density of the high-entropy alloy will be significantly reduced by greatly increasing the content of light elements, the room temperature ductility will not necessarily be enhanced. Meanwhile, the strengths of the alloy at room temperature and high temperature will be significantly reduced due to the reduction in the proportion of heavy elements with high melting points. Furthermore, the above preparation process is complicated and prone to introduce impurities and defects.

SUMMARY OF THE INVENTION

In order to solve the problem of insufficient strength at high temperature and complicated composition design and thermomechanical processing of the existing titanium alloys for aerospace applications, an object of the disclosure is to provide a high-temperature high-entropy alloy, which has a density comparable to that of titanium alloys and mechanical properties superior to those of titanium alloys at both room temperature and high temperature, and the preparation method thereof.

In order to achieve the above object, the disclosure provides a high-temperature high-entropy alloy with light weight and high strength in as-cast state, composed of Ti, Al, Nb, V, and Sc elements, and having an alloy composition of $Ti_{(2.9\text{-}3.1)}Al_{(1.9\text{-}2.1)}Nb_{(0.8\text{-}1.2)}V_{(1.9\text{-}2.1)}Sc_x$, where $0.1 \le x \le 0.3$.

According to a specific embodiment of the disclosure, preferably, the high-temperature high-entropy alloy has an alloy composition of $Ti_3Al_2NbV_2Sc_{0.1}$, $Ti_3Al_2NbV_2Sc_{0.2}$ or $Ti_3Al_2NbV_2Sc_{0.3}$.

According to a specific embodiment of the disclosure, preferably, the high-temperature high-entropy alloy has a density of less than 5.6 g/cm$^3$, more preferably 4.69-5.05 g/cm$^3$.

According to a specific embodiment of the disclosure, preferably, the high-temperature high-entropy alloy has a compressive yield strength of 1,302-1,723 MPa in as-cast state.

According to a specific embodiment of the disclosure, preferably, the high-temperature high-entropy alloy has a compressive deformation of 13%-50% in as-cast state.

According to a specific embodiment of the disclosure, preferably, the high-temperature high-entropy alloy has a yield strength of 967-1,061 MPa at 600° C.

According to a specific embodiment of the disclosure, preferably, the high-temperature high-entropy alloy has a yield strength of 442-568 MPa at 800° C.

The disclosure further provides a method for preparing the high-temperature high-entropy alloy with light weight and high strength in as-cast state, wherein the high-temperature high-entropy alloy is prepared by means of powder metallurgy or additive manufacturing.

According to a specific embodiment of the disclosure, preferably, the preparation method comprises the steps of:

placing Ti, Al, Nb, V and Sc in a crucible in order of melting points from low to high;

melting under a protective atmosphere, during which a titanium ingot is firstly melted under a current condition of 80-120 A and excess oxygen is removed by suction from the chamber, and then Ti, Al, Nb, V and Sc are melted under a current condition of 200-300 A for 1-2 min, to obtain an alloy ingot; and turning over the alloy ingot and repeating the melting, and then cooling to obtain a homogeneous ingot of high-temperature high-entropy alloy with light weight and high strength in as-cast state.

According to a specific embodiment of the disclosure, preferably, the argon protective atmosphere is obtained by:

evacuating the melting chamber; as the vacuum degree reaches 1-5 Pa, backflushing argon gas to $2\times10^4$-$4\times10^4$ Pa and evacuating once again to 1-5 Pa; after repeating the flushing 3-4 times in this manner, evacuating to $3\times10^{-4}$-$5\times10^{-4}$ Pa, and then introducing argon protective gas to $3\times10^4$-$6\times10^4$ Pa.

According to a specific embodiment of the disclosure, preferably, the Ti, Al, Nb, V and Sc materials have a purity of 99.9 wt % or more.

According to a specific embodiment of the disclosure, preferably, the equipment used for melting is a non-consumable vacuum arc furnace, but other suitable equipment is not excluded.

According to a specific embodiment of the disclosure, during the melting process, the crucible is generally a water-cooling copper crucible.

According to a specific embodiment of the disclosure, during the melting process, the protective atmosphere is generally argon.

According to a specific embodiment of the disclosure, preferably, the preparation method further comprises the step of: polishing the five raw materials of Ti, Al, Nb, V and Sc to remove the oxidized surface layer, and ultrasonically cleaning and drying them, before melting.

The technical solution of the disclosure has the following beneficial effects:

1) The disclosure can effectively promote the advancement of aerospace industry by rationally selecting alloying elements and regulating the proportion of light elements to develop a lightweight high-strength high-temperature high-entropy alloy system having a low density (close to the density of titanium alloy) and excellent mechanical properties.

2) The lightweight high-strength high-temperature high-entropy alloy of $Ti_3Al_2NbV_2Sc_x$ series of the disclosure has a density of less than 5.6 g/cm$^3$ and a uniform composition; the as-cast sample has a compressive yield strength of up to 1,302-1,723 MPa and a compressive deformation of up to 50% or more, and it has an extremely strong capability of work-hardening and uniform plastic deformation.

3) The current Ti alloy (Ti600) for aerospace applications has a yield of 1,050 MPa and a deformation of 11% at room temperature, while its yield strength and deformation are only 615 MPa and 16% at 600° C. Its mechanical properties will deteriorate sharply beyond 600° C., and there is no effective solution at present. The lightweight high-strength high-temperature high-entropy alloy of $Ti_3Al_2NbV_2Sc_x$ series of the disclosure has a high-temperature yield strength of up to 967-1,061 MPa and 442-568 MPa at 600° C. and 800° C., respectively, and the mechanical properties thereof are significantly higher than those of the traditional Ti alloy at both room temperature and high temperature.

4) The preparation method of the high-temperature high-entropy alloy with light weight and high strength of the disclosure is simple with uniform structure and less casting defects, which is suitable for promotion and use.

DETAILED DESCRIPTION OF PREFERRED EMBODIMENTS

In order to have a clearer understanding of the technical features, purposes and beneficial effects of the disclosure, the technical solutions of the disclosure are described in detail below, but should not be construed as limiting the implementable scope of the disclosure.

Example 1

This example provided a high-temperature high-entropy alloy with light weight and high strength in as-cast state, $Ti_3Al_2NbV_2Sc_{0.1}$, which was prepared as follows:

Ingredients: five raw materials of Ti, Al, Nb, V and Sc (each of them having a purity of 99.9 wt % or more) were polished to remove the oxidized surface layer, ultrasonically cleaned, dried, and weighed according to the molar ratio of $Ti_3Al_2NbV_2Sc_{0.1}$.

Melting (preparation of the high-temperature high-entropy alloy with light weight and high strength in as-cast state using a vacuum arc melting furnace):

1) the proportioned Ti, Al, Nb, V and Sc were placed in a water-cooling copper crucible inside a non-consumable vacuum arc furnace in order of melting points from low to high;

2) evacuation was carried out; as the vacuum degree reached 5 Pa, argon gas was backflushed to $2\times10^4$ Pa, and evacuation was carried out once again to 5 Pa; after the gas flushing was repeated 3 times in this manner, evacuation was carried out to $4\times10^{-4}$ Pa, and then argon protective gas was introduced to $5\times10^4$ Pa;

3) a melting DC power switch was turned on for melting, during which a titanium ingot was firstly melted under a current condition of 100 A and excess oxygen was removed by Ti-gettering method in the chamber, and then Ti, Al, Nb, V and Sc were melted under a current condition of 200 A for 2 min, to obtain an alloy ingot;

4) the alloy ingot was turned over and repeatedly melted for 4 times, and cooled to obtain a homogeneous ingot of high-temperature high-entropy alloy with light weight and high strength in as-cast state.

The high-temperature high-entropy alloy with light weight and high strength, $Ti_3Al_2NbV_2Sc_{0.1}$, of this example has a density of about 4.92 g/cm$^3$ and a uniform composition.

The prepared $Ti_3Al_2NbV_2Sc_{0.1}$ alloy was tested for mechanical properties at room temperature and high temperature.

Compression experiments were carried out on an Instron 5980 testing machine at room temperature, 600° C. and 800° C.; the strain rate was set to $10^{-3}$ $s^{-1}$; the maximum strain was set to 80%; the samples were cylinders of φ3×6 mm; and the surfaces should be ensured to be clean and flat before testing.

Figure 1:
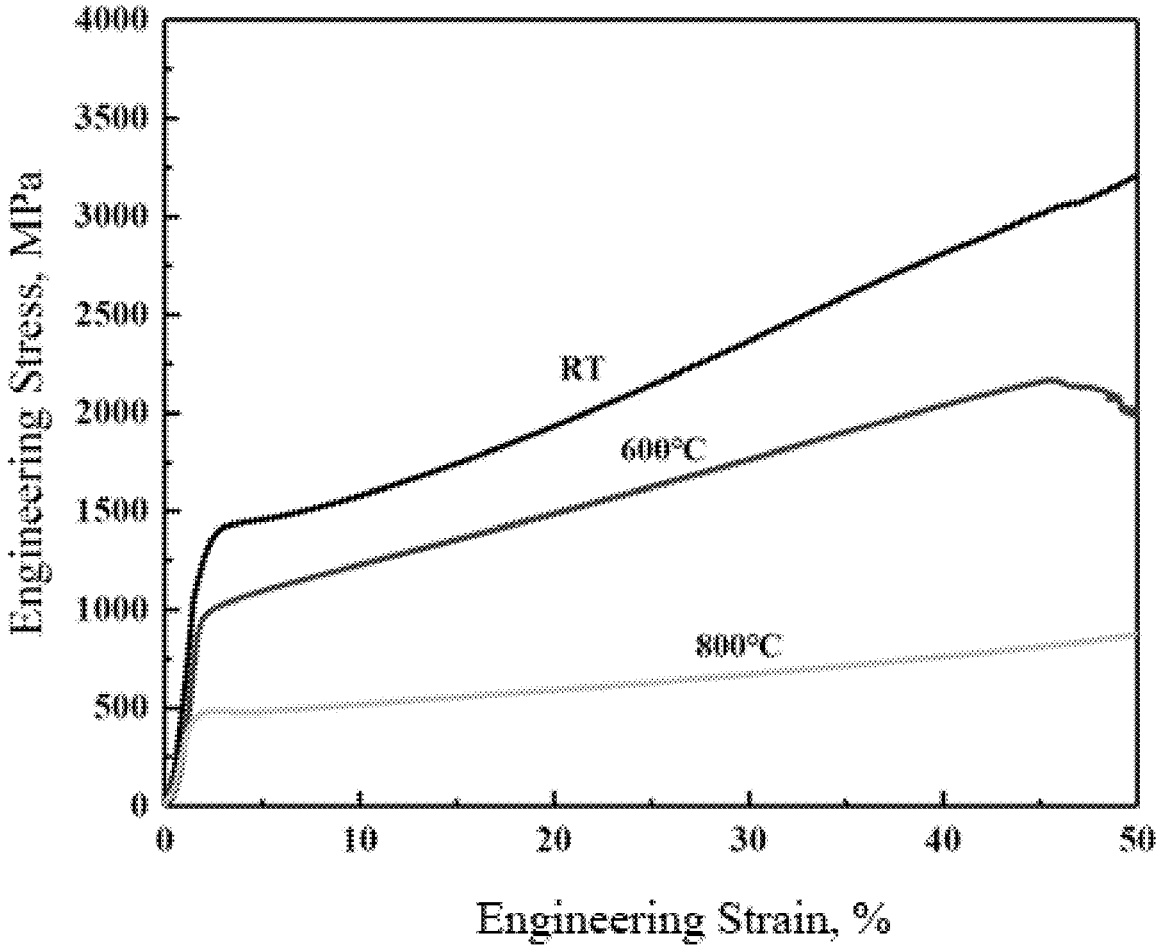
FIG. 1 is an engineering stress-strain curve for $Ti_3Al_2NbV_2Sc_{0.1}$ alloy.

The test results are shown in FIG. 1. The as-cast sample of this example has a compressive yield strength of up to 1,348 MPa and a compressive deformation of up to 50% or more, and it has an extremely strong capability of work-hardening and uniform plastic deformation. Moreover, this alloy has a high-temperature yield strength of up to 967 MPa and 442 MPa at 600° C. and 800° C., respectively, and mechanical properties thereof are significantly higher than those of traditional Ti alloys at both room temperature and high temperature.

Example 2

This example provided a high-temperature high-entropy alloy with light weight and high strength in as-cast state, $Ti_3Al_2NbV_2Sc_{0.2}$, which was prepared as follows:

Ingredients: five raw materials of Ti, Al, Nb, V and Sc (each of them having a purity of 99.9 wt % or more) were polished to remove the oxidized surface layer, ultrasonically cleaned, dried, and weighed according to the molar ratio of $Ti_3Al_2NbV_2Sc_{0.2}$.

Melting (preparation of the high-temperature high-entropy alloy with light weight and high strength in as-cast state using a vacuum arc melting furnace):

1) the proportioned Ti, Al, Nb, V and Sc were placed in a water-cooling copper crucible inside a non-consumable vacuum arc furnace in order of melting points from low to high;
2) evacuation was carried out; as the vacuum degree reached 5 Pa, argon gas was backflushed to $3\times10^4$ Pa, and evacuation was carried out once again to 1 Pa; after the gas flushing was repeated 3 times in this manner, evacuation was carried out to $3\times10^{-4}$ Pa, and then argon protective gas was introduced to $4\times10^4$ Pa;
3) a melting DC power switch was turned on for melting, during which a titanium ingot was firstly melted under a current condition of 80 A and excess oxygen was removed by Ti-gettering method in the chamber, and then Ti, Al, Nb, V and Sc were melted under a current condition of 260 A for 1.5 min, to obtain an alloy ingot;
4) the alloy ingot was turned over and repeatedly melted for 6 times, and cooled to obtain a homogeneous ingot of high-temperature high-entropy alloy with light weight and high strength in as-cast state.

The high-temperature high-entropy alloy with light weight and high strength, $Ti_3Al_2NbV_2Sc_{0.2}$, of this example has a density of about 4.89 g/cm$^3$ and a uniform composition.

Figure 2:
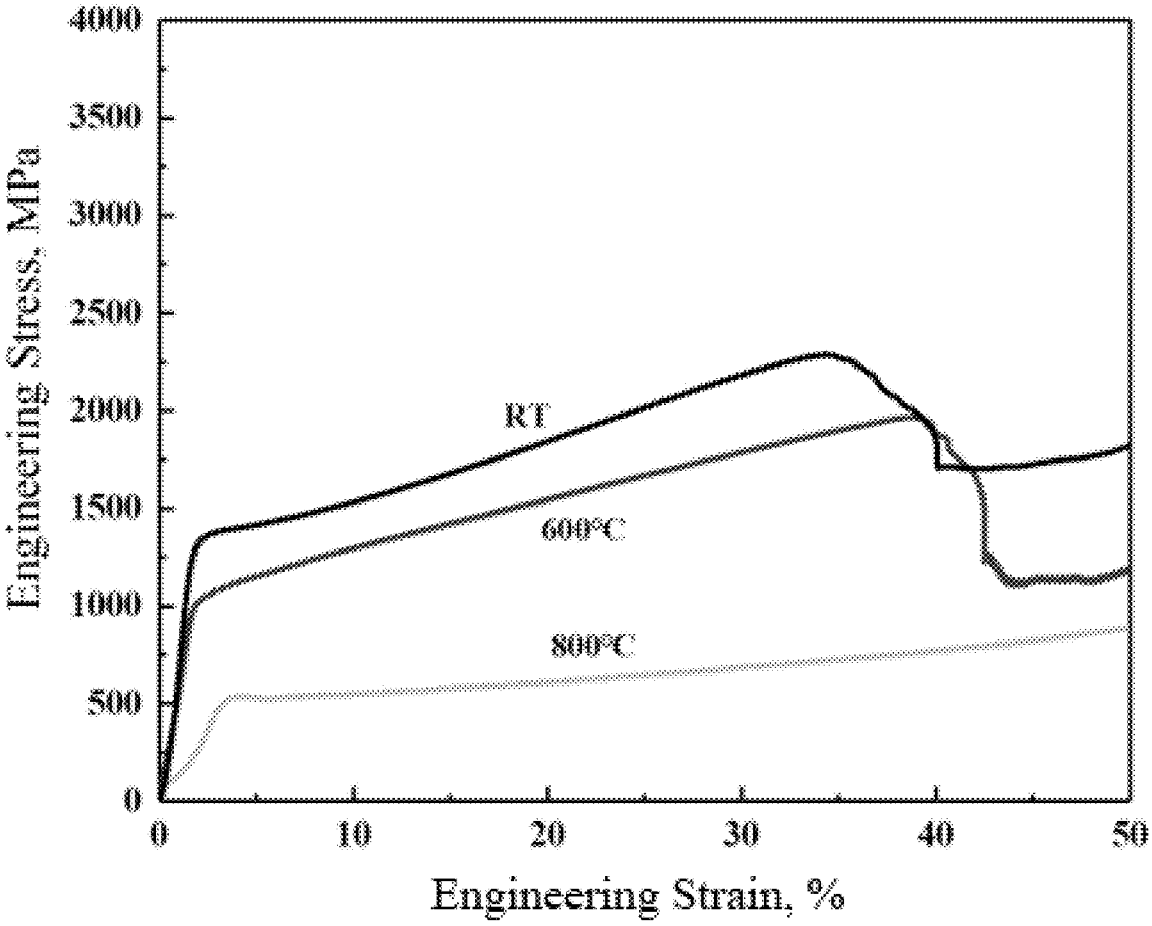
FIG. 2 is an engineering stress-strain curve for $Ti_3Al_2NbV_2Sc_{0.2}$ alloy.

The $Ti_3Al_2NbV_2Sc_{0.2}$ alloy prepared in the example was tested for mechanical properties at room temperature and high temperature in accordance with the same method as in Example 1. The test results are shown in FIG. 2. The as-cast sample of this example has a compressive yield strength of up to 1,302 MPa and a compressive deformation of up to 35%, and it has an extremely strong capability of work-hardening and uniform plastic deformation. Moreover, this alloy has a high-temperature yield strength of up to 1,025 MPa and 547 MPa at 600° C. and 800° C., respectively, and mechanical properties thereof are significantly higher than those of traditional Ti alloys at both room temperature and high temperature.

Example 3

This example provided a high-temperature high-entropy alloy with light weight and high strength in as-cast state, $Ti_3Al_2NbV_2Sc_{0.3}$, which was prepared as follows:

Ingredients: five raw materials of Ti, Al, Nb, V and Sc (each of them having a purity of 99.9 wt % or more), were polished to remove the oxidized surface layer, ultrasonically cleaned, dried, and weighed according to the molar ratio of $Ti_3Al_2NbV_2Sc_{0.3}$.

Melting (preparation of the high-temperature high-entropy alloy with light weight and high strength in as-cast state using a vacuum arc melting furnace):

1) the proportioned Ti, Al, Nb, V and Sc were placed in a water-cooling copper crucible inside a non-consumable vacuum arc furnace in order of melting points from low to high;
2) evacuation was carried out; as the vacuum degree reached 1 Pa, argon gas was backflushed to $4\times10^4$ Pa, and evacuation was carried out once again to 3 Pa; after the gas flushing was repeated 4 times in this manner, evacuation was carried out to $5\times10^{-4}$ Pa, and then argon protective gas was introduced to $6\times10^4$ Pa;
3) a melting DC power switch was turned on for melting, during which a titanium ingot was firstly melted under a current condition of 120 A and excess oxygen was removed by Ti-gettering method in the chamber, and then Ti, Al, Nb, V and Sc were melted under a current condition of 300 A for 1 min, to obtain an alloy ingot;
4) the alloy ingot was turned over and repeatedly melted for 5 times, and cooled to obtain a homogeneous ingot of high-temperature high-entropy alloy with light weight and high strength in as-cast state.

The high-temperature high-entropy alloy with light weight and high strength, $Ti_3Al_2NbV_2Sc_{0.3}$, of this example has a density of about 4.85 g/cm$^3$ and a uniform composition.

The $Ti_3Al_2NbV_2Sc_{0.3}$ alloy prepared in the example was tested for mechanical properties at room temperature and high temperature in accordance with the same method as in Example 1.

Figure 3:
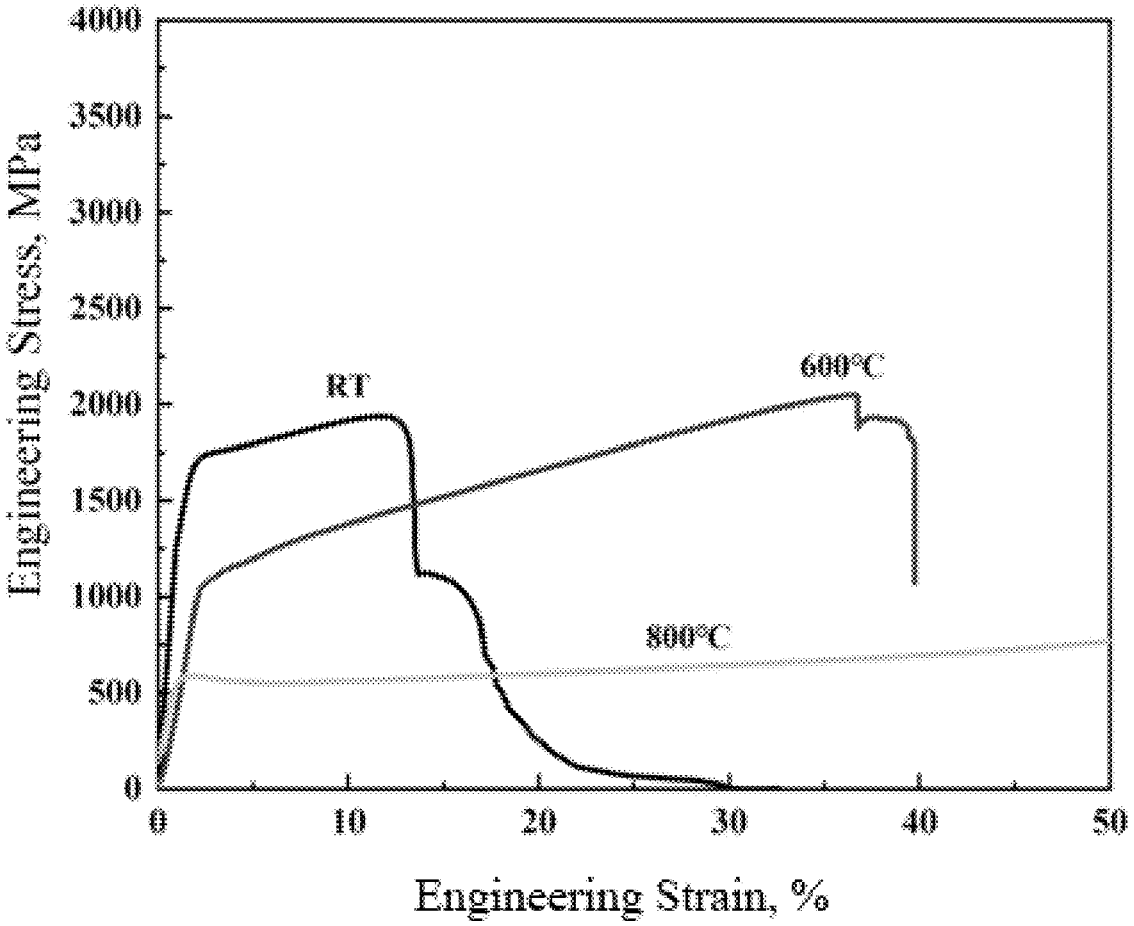
FIG. 3 is an engineering stress-strain curve for $Ti_3Al_2NbV_2Sc_{0.3}$ alloy.

The test results are shown in FIG. 3. The as-cast sample of this example has a compressive yield strength of up to 1,723 MPa and a compressive deformation of up to 13%, and it has an extremely strong capability of work-hardening and uniform plastic deformation. Moreover, this alloy has a high-temperature yield strength of up to 1,061 MPa and 568 MPa at 600° C. and 800° C., respectively, and mechanical properties thereof are significantly higher than those of traditional Ti alloys at both room temperature and high temperature.

The above examples are only preferred embodiments of the disclosure, and are illustrative only, not limiting the disclosure, and the changes, substitutions, modifications, and the like, made by the those skilled in the art without departing from the spirit of the disclosure shall fall within the protection scope of the disclosure.

The invention claimed is:

1. A high-temperature high-entropy alloy with light weight and high strength in as-cast state, composed of Ti, Al, Nb, V, and Sc elements, and having an alloy composition of $Ti_{(2.9\text{-}3.1)}Al_{(1.9\text{-}2.1)}Nb_{(0.8\text{-}1.2)}V_{(1.9\text{-}2.1)}Sc_x$, where $0.1 \leq x \leq 0.3$.

2. The high-temperature high-entropy alloy according to claim 1, wherein the high-temperature high-entropy alloy has an alloy composition of $Ti_3Al_2NbV_2Sc_{0.1}$, $Ti_3Al_2NbV_2Sc_{0.2}$ or $Ti_3Al_2NbV_2Sc_{0.3}$.

3. The high-temperature high-entropy alloy according to claim 1, wherein the high-temperature high-entropy alloy has a density of less than 5.6 g/cm$^3$.

4. The high-temperature high-entropy alloy according to claim 3, wherein the high-temperature high-entropy alloy has a density of 4.69-5.05 g/cm$^3$.

5. The high-temperature high-entropy alloy according to claim 1, wherein the high-temperature high-entropy alloy has a compressive yield strength of 1,302-1,723 MPa in as-cast state.

6. The high-temperature high-entropy alloy according to claim 1, wherein the high-temperature high-entropy alloy has a compressive deformation of 13%-50% in as-cast state.

7. The high-temperature high-entropy alloy according to claim 1, wherein the high-temperature high-entropy alloy has a yield strength of 967-1,061 MPa at 600° C.

8. The high-temperature high-entropy alloy according to claim 1, wherein the high-temperature high-entropy alloy has a yield strength of 442-568 MPa at 800° C.

9. A method for preparing the high-temperature high-entropy alloy with light weight and high strength in as-cast state according to claim 1, wherein the high-temperature high-entropy alloy is prepared by melting.

10. The method according to claim 9, comprising:

placing Ti, Al, Nb, V and Sc in a crucible in order of melting points from low to high;

melting under a protective atmosphere, during which a titanium ingot is firstly melted under a current condition of 80-120 A and excess oxygen is removed by suction from the chamber, and then Ti, Al, Nb, V and Sc are melted under a current condition of 200-300 A for 1-2 min, to obtain an alloy ingot; and turning over the alloy ingot and repeating the melting, and then cooling to obtain a homogeneous ingot of high-temperature high-entropy alloy with light weight and high strength in as-cast state.

11. The method according to claim 10, wherein the protective atmosphere is obtained by:

evacuating the melting chamber; as the vacuum degree reaches 1-5 Pa, backflushing argon gas to $2\times10^4$-$4\times10^4$ Pa and evacuating once again to 1-5 Pa; after repeating the flushing 3-4 times in this manner, evacuating to $3\times10^{-4}$-$5\times10^{-4}$ Pa, and then introducing argon protective gas to $3\times10^4$-$6\times10^4$ Pa.

* * * * *